US010875084B2

(12) United States Patent
Niane et al.

(10) Patent No.: US 10,875,084 B2
(45) Date of Patent: Dec. 29, 2020

(54) CLUSTER MODEL AND SHELL FOR OBTAINING AN ACCESSORY FOR THE INDEPENDENT HANDLING OF FORMED PARTS AND ASSOCIATED METHOD

(71) Applicants: SAFRAN, Paris (FR); SAFRAN AIRCRAFT ENGINES, Paris (FR)

(72) Inventors: Ngadia Taha Niane, Moissy-Cramayel (FR); Ramzi Bohli, Moissy-Cramayel (FR); Loic Galvin, Moissy-Cramayel (FR); Said Boukerma, Moissy-Cramayel (FR)

(73) Assignees: SAFRAN, Paris (FR); SAFRAN AIRCRAFT ENGINES, Paris (FR)

( * ) Notice: Subject to any disclaimer, the term of this patent is extended or adjusted under 35 U.S.C. 154(b) by 38 days.

(21) Appl. No.: 16/473,150

(22) PCT Filed: Dec. 22, 2017

(86) PCT No.: PCT/FR2017/053815
§ 371 (c)(1),
(2) Date: Jun. 24, 2019

(87) PCT Pub. No.: WO2018/122516
PCT Pub. Date: Jul. 5, 2018

(65) Prior Publication Data

US 2020/0101526 A1 Apr. 2, 2020

(30) Foreign Application Priority Data

Dec. 26, 2016 (FR) ..... 16 63392

(51) Int. Cl.
*B22C 9/04* (2006.01)
*B22C 7/02* (2006.01)
(Continued)

(52) U.S. Cl.
CPC ..... *B22C 9/043* (2013.01); *B22C 7/02* (2013.01); *B22C 9/082* (2013.01); *B22C 9/22* (2013.01);
(Continued)

(58) Field of Classification Search
CPC ..... B22C 9/043; B22C 9/082; B22C 9/22; B22C 7/00; B22C 7/02
See application file for complete search history.

(56) References Cited

U.S. PATENT DOCUMENTS 7,231,955 B1 6/2007 Bullied et al.
2015/0174646 A1 6/2015 Marques et al.
(Continued)

FOREIGN PATENT DOCUMENTS

CN 105290333 A 2/2016
FR 2 985 924 A1 7/2013
(Continued)

OTHER PUBLICATIONS

International Search Report dated Apr. 19, 2018 in PCT/FR2017/053815 filed Dec. 22, 2017.
(Continued)

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

A cluster model and a shell for the production, by lost wax casting, of a plurality of turbomachine elements, are provided. The shell includes a central sprue that is fluidly connected to a casting cup for receiving molten metal; a plurality of shell elements; a plurality of bottom feed conduits for the shell elements; and a handling accessory shell that is independent of the plurality of shell elements and of their metal supply circuit, such that there is no fluid con-
(Continued)

nection to the shell elements. The handling accessory shell is fluidly connected to the central sprue so as to allow top-pour casting of the handling accessory shell.

10 Claims, 1 Drawing Sheet

(51) Int. Cl.

| | |
|---|---|
| *B22C 9/08* | (2006.01) |
| *B22C 9/22* | (2006.01) |
| *B22D 27/04* | (2006.01) |

(52) U.S. Cl.
CPC ..... *B22D 27/045* (2013.01); *F05D 2230/211* (2013.01)

(56) References Cited

U.S. PATENT DOCUMENTS

| | | | |
|---|---|---|---|
| 2016/0288201 | A1 | 10/2016 | Bullied et al. |
| 2017/0239712 | A1 | 8/2017 | Tran et al. |

FOREIGN PATENT DOCUMENTS

| | | | |
|---|---|---|---|
| FR | 2 990 370 | A1 | 11/2013 |
| FR | 3 026 973 | A1 | 4/2016 |
| WO | WO 2015/080854 | A1 | 6/2015 |

OTHER PUBLICATIONS

French Preliminary Search Report dated Oct. 4, 2017 in French Application No. 16 63392 filed Dec. 26, 2016.

CLUSTER MODEL AND SHELL FOR OBTAINING AN ACCESSORY FOR THE INDEPENDENT HANDLING OF FORMED PARTS AND ASSOCIATED METHOD

TECHNICAL FIELD

The present invention relates to the field of the production in cluster of elements, in particular turbomachine bladed elements, by the lost wax casting technique. Each element is preferentially an individual blade such as a turbine or compressor moveable impeller blade.

The invention relates to any type of terrestrial or aeronautical turbomachines, and in particular aircraft turbomachines such as turbojets and turboprops.

More specifically, the invention relates to the design of the cluster model and same of the shell intended to be formed about said model partially made of wax, shell wherein the metal is intended to be cast for obtaining turbomachine elements.

Thus, the invention proposes a cluster model and a shell for obtaining at least one handling accessory of the cluster that is independent of the formed turbomachine elements, as well as a related method for the production, by lost wax casting, of a plurality of turbomachine elements.

STATE OF THE PRIOR ART

The lost wax casting technique for simultaneously producing a plurality of aircraft turbomachine bladed elements, such as moveable blades, is well known in the prior art. Such a technique is for example described in French patent application FR 2 985 924 A1.

As a reminder, lost wax precision casting consists of producing in wax, by injecting into tools, a model of each of the bladed elements sought. The assembly of said models on a wax dispenser makes it possible to create a cluster model that is subsequently dipped into various substances in order to form about same a ceramic shell of substantially uniform thickness. The cluster model is also commonly known as "replica", "cluster assembly" or even "wax tree", although the components thereof are not all necessarily made of wax or of another sacrificial material.

The method is continued by melting the wax, which then leaves the exact mould thereof in the ceramic shell, wherein the molten metal is poured, via a casting cup assembled on the metal dispenser. After cooling the metal, the shell is destroyed and the metal parts are separated and finished.

Said technique offers the advantage of dimensional precision, making it possible to reduce or even do away with some machining operations. In addition, it offers a very good surface finish.

In the field of lost wax casting, the principle of top-pour casting, or gravity, of the molten metal is known which consists of producing the cast of the metal from the top in the moulds of the shell for forming the turbomachine parts. According to said principle, the molten metal is poured into the cup then generally reaches an annular system for feeding the plurality of moulds for forming the turbomachine parts, as described for example in French patent application FR 2 985 924 A1.

Advantageously, such a feed system may also be used as a ring for handling the cluster at various steps of the production method, in particular upon furnace exit, during the shake-out, that is to say during the destruction of the shell, or even during the cutting for obtaining the metal turbomachine parts.

Moreover, in the field of lost wax casting, the principle of bottom-pour casting of the molten metal is also known which consists on the contrary of producing the cast of the metal from the bottom in the moulds of the shell for forming the turbomachine parts. More often, the molten metal is poured into the cup then the specific conduits connected to the cup therefore make it possible to inject the metal from the bottom portion of the moulds.

In the context of bottom-pour casting, the kinetic energy stored before the entry into the moulds is greater so that the velocity is higher. The metal feeding means therefore promote the losses of head and have for example an elbow for reducing the velocity.

In addition, as a general rule, the cluster for which the bottom-pour casting principle is applied is provided with a feed system forming a ring for handling the cluster such as previously described in relation to the top-pour casting principle.

Said handling ring is typically directly connected to the parts to be formed. Therefore, if the mass of the ring is equivalent to same of the parts, there is a high risk that the ring mechanically interacts with the parts during the solidification and/or during the cooling, which may lead to core offset or crack type defects on the parts, when the forces are sufficient, but also in the case of single crystal solidification with the generation of recrystallised grains due to the internal stresses generated in the parts.

Therefore, there is a need for optimisation of the current lost wax casting technique, and in particular in the context of the bottom-pour casting principle with a cluster model provided with handling accessories, in order to avoid the appearance of the above-mentioned defects typically generated by the harmful interactions between the parts to be formed and cluster handling accessories, such as a handling ring formed by a top-pour casting feed system.

In particular, there is a need for making it possible to both benefit from the advantages of bottom-pour gravity casting without degrading the metallurgical health of turbomachine parts, and to provide the casting of handling accessories, such as a ring for handling the cluster again without degrading the metallurgical health of turbomachine parts.

DISCLOSURE OF THE INVENTION

The aim of the invention is to remedy at least partially the needs mentioned above and the disadvantages relative to the embodiments of the prior art.

Thus, the subject matter of the invention, according to one of the aspects thereof, is a cluster model, about which is intended to be formed a shell for the production, by lost wax casting, of a plurality of elements, in particular turbomachine bladed elements, said model having a longitudinal axis and comprising:

a replica, for example made of wax, of a casting cup suitable for the injection of molten metal into the shell, a replica, for example made of metal, of a central sprue (or support) extending along the longitudinal axis, suitable for being fluidically connected to the casting cup for receiving the molten metal, a plurality of replicas, for example made of wax, of shell elements, in particular bladed, each intended for obtaining one of the turbomachine elements, each shell element including a first bottom end portion and a second top end portion, characterised in that it further comprises:

a plurality of replicas, for example made of wax, of bottom feed conduits for the shell elements, suitable for being fluidically connected to the central sprue and the second bottom end portions of the shell elements so as to allow bottom-pour casting of the shell elements, a replica, for example made of wax, of a handling accessory shell that is independent of the plurality of shell elements and of the metal supply circuit thereof, such that there is no fluidic connection to the shell elements, the handling accessory shell being suitable for being fluidically connected to the central sprue so as to allow top-pour casting of the handling accessory shell.

Again, the subject matter of the invention, according to one of the aspects thereof, is a shell for the production, by lost wax casting, of a plurality of elements, in particular turbomachine bladed elements, said shell in cluster form having a longitudinal axis and comprising:

a casting cup suitable for the injection of molten metal into the shell, a central sprue extending along the longitudinal axis, of the shell that is fluidically connected to the casting cup for receiving the molten metal, a plurality of shell elements, in particular bladed, each intended for obtaining one of the turbomachine elements, each shell element including a first bottom end portion and a second top end portion, characterised in that it further comprises:

a plurality of bottom feed conduits for the shell elements that are fluidically connected to the central sprue and the second bottom end portions of the shell elements so as to allow bottom-pour casting of the shell elements, a handling accessory shell that is independent of the plurality of shell elements and of the metal supply circuit thereof, such that there is no fluidic connection to the shell elements, the handling accessory shell being fluidically connected to the central sprue so as to allow top-pour casting of the handling accessory shell.

Advantageously, the handling accessory, in particular in handling ring form, has in the invention a single aim of handling of the cluster, in particular upon furnace exit, during the shake-out and during the cutting, and no longer an aim of molten metal feeding as according to the previously described top-pour casting principle. Preferentially, the handling accessory has sufficient mechanical properties to avoid yielding under its own weight during the handling and principally to avoid fracturing during cooling.

The cluster model and the shell according to the invention may further comprise one or more of the following features taken alone or according to any possible technical combinations.

The handling accessory shell may comprise radial arms fluidically connecting a handling ring shell, centred about the longitudinal axis, to the central sprue.

Moreover, the handling accessory shell may comprise a central element of central axis coinciding with the longitudinal axis of the shell, attached to the central sprue or to the casting cup, the radial arms fluidically connecting the handling ring shell to the central element.

In addition, the shell elements may be advantageously arranged about the longitudinal axis, being spaced circumferentially apart from one another, and defining an inner space centred about the longitudinal axis wherein the central sprue is located.

According to a first alternative embodiment, each shell element may be fluidically connected, at the level of the second top end portion thereof, to a single wax discharge conduit connected to the casting cup.

According to a second alternative embodiment, each shell element may be fluidically connected, at the level of the second top end portion thereof, to a single wax discharge conduit. The shell may comprise at least one first assembly and one second assembly of a plurality of wax discharge conduits respectively connected to one another by at least one first lateral conduit and one second lateral conduit, said at least one first lateral conduit and one second lateral conduit being respectively fluidically connected to the casting cup via at least one first and one second main wax discharge conduits extending respectively between the casting cup and said at least one first and one second lateral conduits.

The shell turbomachine elements may for example be shell bladed elements, each designed for obtaining a single moveable blade.

Moreover, the subject matter of the invention, according to one of the aspects thereof, is a method for producing, by lost wax casting, a plurality of elements, in particular turbomachine bladed elements, characterised in that it is implemented using a shell such as previously defined and/or using a cluster model such as previously defined, the method comprising a step for casting the metal into the shell.

Advantageously, the method may comprise a step for producing a material other than metal, in particular ceramic, for forming a handling accessory.

BRIEF DESCRIPTION OF THE DRAWINGS

The invention may be better understood on reading the following detailed description, non-limiting examples of implementation thereof, as well as examination of the figures, schematic and partial, of the drawing appended, wherein.

In all of said figures, identical references may designate identical or similar elements.

In addition, the various portions shown in the figures are not necessarily according to a uniform scale, to make the figures more readable.

DETAILED DISCLOSURE OF SPECIFIC EMBODIMENTS

It is noted that, in the entire description, the possible terms "top", "bottom", "above" and "below" are understood according to the orientation of the views on the figures.

In addition, it is noted that the invention makes it possible to produce turbomachine elements, that may for example be compressor or turbine moveable blades, or even turbine or compressor stator blades, produced alone or by sectors including a plurality of blades.

It is also noted that although the features mentioned below are described in relation to the shell 1, it must be understood that they apply in a similar way to the cluster model, about which said shell 1 is intended to be formed.

Figure 1:
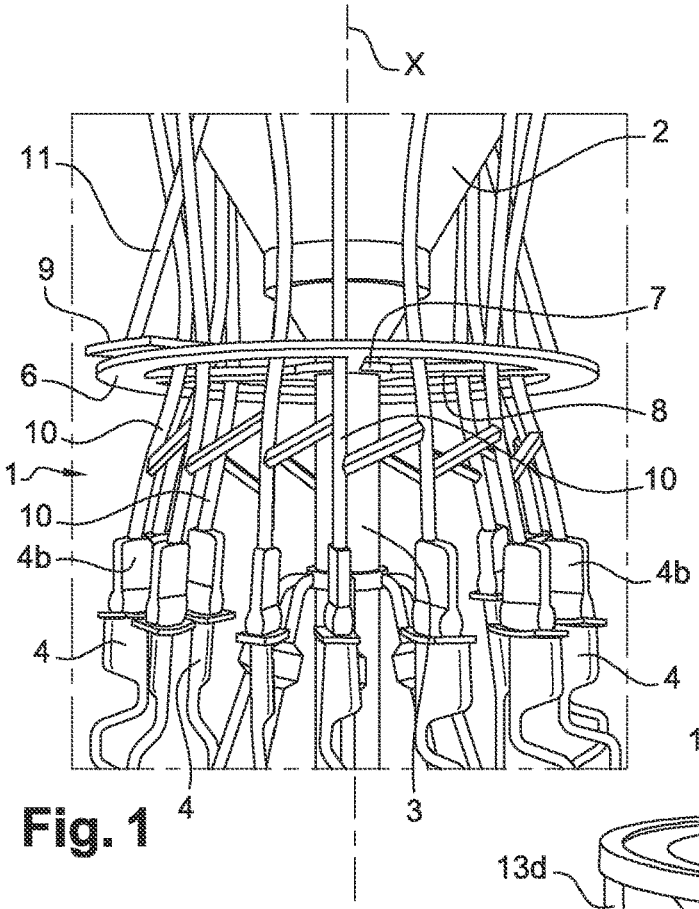
FIG. 1 shows a partial perspective view of a first example of embodiment of a shell according to the invention, for the production, by lost wax casting, of a plurality of turbomachine elements.

In reference to FIG. 1, a first example of embodiment is shown of a shell according to the invention, for the production, by lost wax casting, of a plurality of turbomachine elements, in particular bladed elements.

For the production of the shell, a cluster model (not shown) is first of all produced about which the shell 1 preferentially made of ceramic is intended to be formed. Said cluster model essentially consists of sacrificial elements made of wax, but not exclusively. However, in the interest of simplicity, it is known as "wax model".

The implementation of the step for producing the ceramic shell 1 is carried out in a known way by dipping the wax model into successive baths (not shown).

After the drying thereof, the shell 1 obtained has a general cluster shape, and comprises shell elements that will be described hereafter, with the shell 1 shown in FIG. 1 in a position such as subsequently adopted when it is filled with molten metal.

The shell 1 comprises first of all a metal casting cup 2, which can be fully or partially covered by the shell 1. Said casting cup 2 is fluidically connected to a central sprue 3 extending along the longitudinal axis X of the shell 1. Said central sprue 3 preferentially takes the form of a hollow cylinder of axis X that extends from the bottom of the casting cup 2 up to the level of the bottom ends 4*a* of the shell bladed elements 4.

The central sprue 3 advantageously connects, in a known manner, to the bottom feed conduits 5, visible in FIG. 2 subsequently described, of the shell bladed elements 4 intended to form the metal parts in the form of bladed elements. In other words, the molten metal is injected into the casting cup 2, then passes through the central sprue 3 and is injected, in the bottom portion, into the bottom feed conduits 5 so as to make it possible to fill the shell bladed elements 4 via the bottom, that is to say from bottom to top.

The shell bladed elements 4 are said to be bladed because after elimination of the wax replica, they each form within same a cavity corresponding to a blade. Said shell bladed elements 4 extend upwards, by being arranged about the axis X, and also about the central sprue 3 extending along said same axis, downwards from the bottom of the casting cup 2. The shell bladed elements 4 form the peripheral wall of the shell 1, of longitudinal axis X. They are spaced circumferentially apart from one another, and define an inner space centred about said axis X, space wherein the central sprue 3 is therefore located.

Moreover, in accordance with the invention, the shell 1 comprises a handling accessory shell 6 that is totally independent of the shell bladed elements 4 and of the metal supply circuit thereof.

Said handling accessory shell 6 comprises for example a central element 7 of revolutionary, cylindrical or conical shape, of central axis coinciding with the central axis X of the shell 1, oriented vertically.

Said central element 7 is attached to the central sprue 3, or even to the casting cup 2 directly. Radial arms 8, further visible in FIG. 2, connect the central element 7 to a handling ring shell 9 centred about the axis X. The radial arms 8 and the handling ring shell 9 are for example arranged just below the casting cup 2.

Advantageously, the radial arms 8 and the central arm 7 are fluidically connected to the central sprue 3, same fluidically connected to the casting cup 2, in order to make it possible to produce the handling accessory in metal. In accordance with the invention, top-pour casting is produced in order to obtain said handling accessory. Thus, the invention implements both bottom-pour casting so as to allow the formation of turbomachine bladed elements and top-pour casting so as to allow the formation of the handling accessory, the bladed elements and the handling accessory thus being produced in a totally independent way in order to avoid the appearance of production defects as previously explained.

Moreover, in said example of embodiment in FIG. 1, each shell bladed element 4 is fluidically connected, at the level of the top end 4*b* thereof, to a single wax discharge conduit 10, again called wax puller or again dewaxing vents 10. Said wax discharge conduits 10 are oriented substantially vertical in the position of the shell 1 illustrated in FIG. 1.

Furthermore, FIG. 1 also shows that, for reinforcing the holding of the handling ring shell 9, it may be provided a plurality of ceramic holding reinforcements 11 connecting the ring shell 9 to the casting cup 2.

Figure 2:
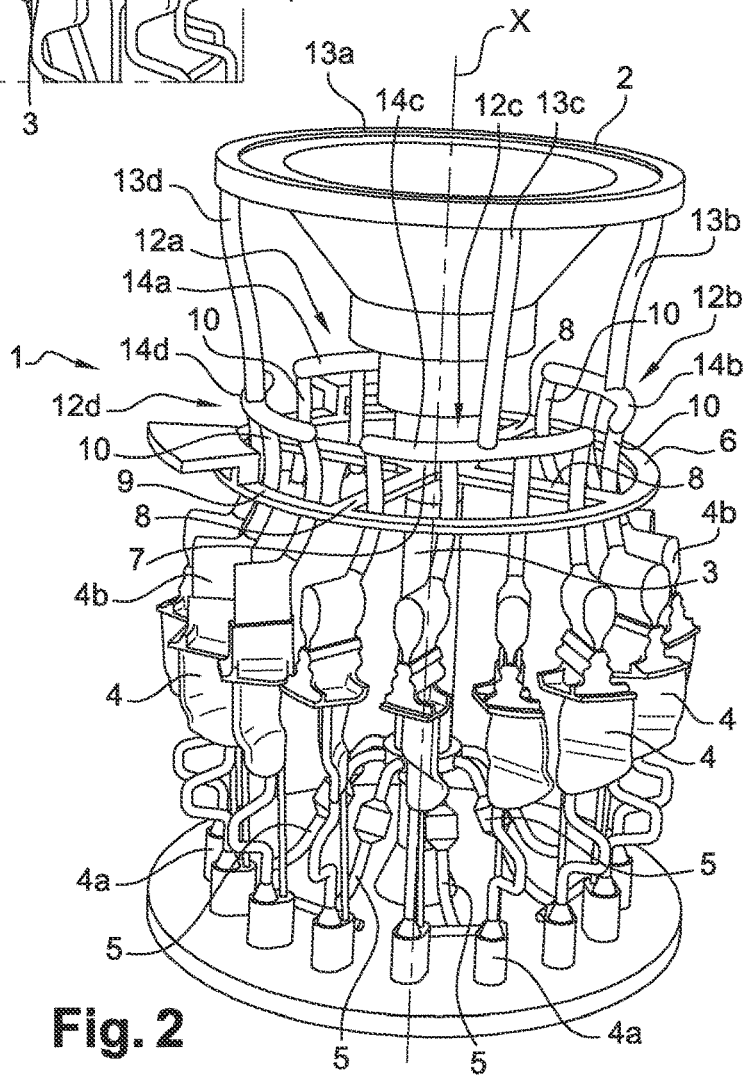
FIG. 2 shows a partial perspective view of a second example of embodiment of a shell according to the invention, for the production, by lost wax casting, of a plurality of turbomachine elements, forming an alternative embodiment of FIG. 1.

In the example of embodiment in FIG. 2, the choice was made not to link the wax puller to a part formed by a shell bladed element 4, in other words not to combine a wax puller with each shell bladed element 4. Thus, in said example, a first 12*a*, a second 12*b*, a third 12*c* and a fourth 12*d* assembly of four wax discharge conduits 10 respectively combined with four shell bladed elements 4 are each fluidically connected to one another by respectively the first 14*a*, second 14*b*, third 14*c* and fourth 14*d* lateral conduits.

The wax discharge conduits 10 are therefore partially connected to one another in order to make them rigidly connected. In this way, it is possible to avoid having excessive vibrations during the shake-out step in particular. Indeed, said vibrations could be harmful by causing recrystallisation, and therefore the appearance of recrystallised grains on the formed parts.

At the level of each of the four lateral conduits 14*a*-14*d* is fluidically connected a main wax discharge conduit 13*a*, 13*b*, 13*c* or 13*d*, or wax puller 13*a*-13*d*, same fluidically connected to the casting cup 2.

In other words, the discharge of the wax, in said example, is carried out in the casting cup 2 via the first 13*a*, second 13*b*, third 13*c* and fourth 13*d* main wax discharge conduits, each being fluidically connected to a plurality of shell bladed elements 4.

Advantageously, such an embodiment according to the example in FIG. 2 may make it possible to improve the casting and safety aspects. This may also make it possible to reduce or increase again the stresses in the blade during the solidification phase and more precise discharge of the wax. In this way, it may therefore be possible to optimise the dewaxing system.

After obtaining the shell 1 and eliminating the essential of the cluster model enclosed within same, the shell 1 is preheated at high temperature in a dedicated furnace, for example between 1,000 and 1,200° C., in order to promote the fluidity of the metal in the shell 1 during the casting.

Upon exiting from the preheating of the shell 1, the metal exiting a smelting furnace is cast in the shell bladed elements 4 via the casting cup 2, with the shell 1 in the position such as shown in FIG. 1 or 2, that is to say with the casting cup 2 open upwards and always the axis X oriented vertically.

The molten metal therefore successively follows the casting cup 2, then the central sprue 3, the central element 7, the radial arms 8 and the ring shell 9 for forming the handling accessory in top-pour casting, and almost simultaneously the central sprue 3, the bottom feed conduits 5 and the shell bladed elements 4 for forming the turbomachine bladed elements by bottom-pour casting.

After the cooling of the metal following the casting, the shell 1 is destroyed, then the moveable blades are extracted from the cluster for possible machining operations and finishing and inspection operations.

Advantageously, stiffeners may be added on each radial arm 8 of the handling ring in order to stiffen the cluster and avoid allowing it to sag under its own weight.

In addition, the embodiment of a handling ring, and more generally of a handling accessory, that is totally independent of the bladed elements makes it possible to be able to reduce the dimensions of the handling ring in relation to same formed by the feed system in a top-pour casting solution such as previously described in the part relating to the prior art. Said reduction of dimension may therefore result in a reduction of the metal mass, in particular greater than 50%. Furthermore, such a handling accessory, and in particular such a handling ring, may be produced other than in metal, and in particular in ceramic, because it is only used for the handling and no longer for the feeding of shell bladed elements 4. Therefore, the metal mass may even be reduced to zero if a material other than metal is used. Said reduction of size and metal mass of the handling accessory may be carried out whilst keeping sufficient mechanical properties.

Moreover, bottom-pour casting of the cluster may make it possible to protect the metallurgical health of the formed parts. Thus, it is possible to reduce the risks of core breakage and offset because the corrosion velocities of the metal are very low, typically between 0.2 and 0.6 m/s. In addition, it is possible to reduce the metallurgical defects such as those of inclusion, oxidation, recrystallised grains, interference, among other things, as previously described in relation to the prior art.

In general, the invention makes it possible to obtain an aeration of the cluster and an increase of the stiffening thereof with a better resistance to casting and finishing. The principle according to the invention aiming to isolate the handling ring from the bladed elements makes it possible to reduce the plastic deformations and stresses during the solidification and cooling.

Indeed, the invention seeks to limit the thermomechanical stresses caused by thermal gradients in the direction of the directed solidification. The risks of recrystallised grains and cold cracks are mitigated with the solution of the invention. As this concerns a directed solidification method, the mould is cooled heterogeneously, the bottom cooling first, causing traction of the hot metal by the cold metal. By controlling the temperature in the bottom of the mould, it is possible to control the temperature gradient according to the direction of solidification. A balance of the metal masses of the top portion in relation to the bottom portion is established, and the stresses on all of the parts produced are mitigated and better distributed.

Furthermore, it should be noted that a numerical validation of the solution of the invention by estimation of the plasticity criterion of the Von Mises criterion type at the end of solidification shows that the stresses are significantly mitigated in the order of 45 to 50% when the cluster is directly connected to the casting cup 2, as according to the examples in FIGS. 1 and 2 according to the invention, rather than being connected to a feed system in the form of a ring as according to the conventional top-pour casting solution of the prior art. Therefore, the probability of forming metallurgical defects, in particular of recrystallised grain type, is lower.

Advantageously, the principle of the invention previously described may be applied to any type of cluster configuration.

Of course, the invention is not limited to the examples of embodiments that have just been described. Various modifications may be made by the person skilled in the art.

The invention claimed is:

1. A cluster model, about which is intended to be formed a shell for production, by lost wax casting, of a plurality of turbomachine elements, said model having a longitudinal axis and comprising:

a replica of a casting cup suitable for the injection of molten metal into the shell;

a replica of a central sprue extending along the longitudinal axis, suitable for being fluidically connected to the casting cup for receiving the molten metal;

a plurality of replicas of shell elements each intended for obtaining one of the turbomachine elements, each shell element including a first bottom end portion and a second top end portion;

a plurality of replicas of bottom feed conduits for the shell elements, suitable for being fluidically connected to the central sprue and the second bottom end portions of the shell elements so as to allow bottom-pour casting of the shell elements; and a replica of a handling accessory shell that is independent of the plurality of shell elements and of a metal supply circuit thereof, such that there is no fluidic connection to the shell elements, the handling accessory shell being suitable for being fluidically connected to the central sprue so as to allow top-pour casting of the handling accessory shell.

2. A shell for production, by lost wax casting, of a plurality of turbomachine elements, said shell having a longitudinal axis and comprising:

a casting cup suitable for the injection of molten metal into the shell;

a central sprue extending along the longitudinal axis, of the shell that is fluidically connected to the casting cup for receiving the molten metal;

a plurality of shell elements each intended for obtaining one of the turbomachine elements, each shell element including a first bottom end portion and a second top end portion;

a plurality of bottom feed conduits for the shell elements that are fluidically connected to the central sprue and the second bottom end portions of the shell elements so as to allow bottom-pour casting of the shell elements; and a handling accessory shell that is independent of the plurality of shell elements and of a metal supply circuit thereof, such that there is no fluidic connection to the shell elements, the handling accessory shell being fluidically connected to the central sprue so as to allow top-pour casting of the handling accessory shell.

3. The shell according to claim 2, wherein the handling accessory shell comprises radial arms fluidically connecting a handling ring shell, centered about the longitudinal axis, to the central sprue.

4. The shell according to claim 3, wherein the handling accessory shell comprises a central element of central axis coinciding with the longitudinal axis of the shell, attached to the central sprue or to the casting cup, the radial arms fluidically connecting the handling ring shell to the central element.

5. The shell according to claim 2, wherein the shell elements arranged about the longitudinal axis, being spaced circumferentially apart from one another, and defining an inner space centered about the longitudinal axis wherein the central sprue is located.

6. The shell according to claim 2, wherein each shell element is fluidically connected, at the level of the second top end portion thereof, to a single wax discharge conduit connected to the casting cup.

7. The shell according to claim 2, wherein each shell element is fluidically connected, at a level of the second top end portion thereof, to a single wax discharge conduit, and wherein the shell comprises at least one first assembly and one second assembly of a plurality of wax discharge conduits respectively connected to one another by at least one first lateral conduit and one second lateral conduit, said at least one first lateral conduit and one second lateral conduit being respectively fluidically connected to the casting cup via at least one first and one second main wax discharge conduits extending respectively between the casting cup and said at least one first and one second lateral conduits.

8. The shell according to claim 2, wherein the shell turbomachine elements are shell bladed elements, each designed for obtaining a single movable blade.

9. A method for producing, by lost wax casting, a plurality of turbomachine elements, using the shell according to claim 2, the method comprising:

casting the metal in the shell for forming at least the turbomachine elements.

10. The method according to claim 9, further comprising producing a material other than metal for forming the handling accessory.

* * * * *